US011390408B2

(12) United States Patent
Duncan

(10) Patent No.: US 11,390,408 B2
(45) Date of Patent: Jul. 19, 2022

(54) SYSTEM AND METHOD FOR APPLYING TUBULAR BANDS TO CONTAINERS UTILIZING ANGLED BAND EJECTION

(71) Applicant: Axon LLC, Raleigh, NC (US)

(72) Inventor: Adam W. Duncan, Apex, NC (US)

(73) Assignee: AXON LLC, Raleigh, NC (US)

( * ) Notice: Subject to any disclaimer, the term of this patent is extended or adjusted under 35 U.S.C. 154(b) by 60 days.

(21) Appl. No.: 17/103,254

(22) Filed: Nov. 24, 2020

(65) Prior Publication Data

US 2022/0161953 A1 May 26, 2022

(51) Int. Cl.

| | |
|---|---|
| ***B65C 3/06*** | (2006.01) |
| ***B67B 5/03*** | (2006.01) |
| ***B65B 53/06*** | (2006.01) |
| ***B65B 61/06*** | (2006.01) |

(52) U.S. Cl.

CPC ..... *B65B 53/06* (2013.01); *B65B 61/06* (2013.01); *B65C 3/065* (2013.01); *B67B 5/03* (2013.01); *B67B 5/036* (2013.01)

(58) Field of Classification Search

CPC .. B67B 5/00; B67B 5/03; B67B 5/034; B67B 5/036; B65C 3/065; B65C 3/20

USPC ..... 53/137.2, 585, 290, 291, 295, 296; 156/DIG. 15

See application file for complete search history.

(56) References Cited

U.S. PATENT DOCUMENTS

| | | | | |
|---|---|---|---|---|
| 2,986,860 | A * | 6/1961 | Salzwedel | B67B 5/03 156/DIG. 15 |
| 3,594,975 | A * | 7/1971 | Abrecht | B65B 9/14 53/291 |
| 4,562,688 | A | 1/1986 | Mueller | |
| 4,600,371 | A * | 7/1986 | Fresnel | B65B 9/14 53/563 |
| 4,914,893 | A | 4/1990 | Strub | |
| 4,947,627 | A * | 8/1990 | Scheidegger | B65D 41/54 53/295 |
| 5,086,682 | A * | 2/1992 | Strub et al. | B26D 1/045 83/578 |
| 5,165,215 | A * | 11/1992 | Menayan | B67B 5/03 53/313 |
| 5,305,578 | A * | 4/1994 | Menayan | B65B 9/13 53/399 |
| 5,711,135 | A | 1/1998 | Menayan | |
| 6,684,599 | B1 * | 2/2004 | Fresnel | B65B 9/14 53/64 |
| 7,398,811 | B1 | 7/2008 | Duncan | |
| 2013/0118122 | A1 * | 5/2013 | Heeman | B65C 9/0065 53/399 |
| 2018/0141695 | A1 * | 5/2018 | Duncan | B65C 3/24 |

FOREIGN PATENT DOCUMENTS

| | | | | |
|---|---|---|---|---|
| DE | 20104972 U1 * | 4/2002 | | B65C 3/065 |
| DE | 102014216192 A1 * | 2/2016 | | B26F 3/02 |
| DE | 102014216193 A1 * | 2/2016 | | B65B 53/00 |
| DE | 202015103924 U1 * | 12/2016 | | B65C 3/065 |
| EP | 2949451 A1 * | 12/2015 | | B29C 63/423 |
| FR | 2606741 A * | 5/1988 | | B65C 1/025 |

* cited by examiner

*Primary Examiner* — Stephen F. Gerrity

(74) *Attorney, Agent, or Firm* — Thompson Hine LLP

(57) ABSTRACT

A machine for applying a tubular band to a container moving in a feed direction includes a mandrel assembly about which tubular film is passed. The mandrel assembly is configured to eject tubular bands in an angular direction or orientation that is partly against the feed direction.

20 Claims, 7 Drawing Sheets

SYSTEM AND METHOD FOR APPLYING TUBULAR BANDS TO CONTAINERS UTILIZING ANGLED BAND EJECTION

TECHNICAL FIELD

The present application relates generally to machines that apply tubular shrink sleeve material to containers and, more particularly, to a system and method for applying tubular bands, such as tamper evident bands, to the necks of moving containers.

BACKGROUND

Tubular shrink sleeve application devices commonly utilize a mandrel assembly over which a tubular shrink film is moved for cutting, and then the cut sleeve-type label is ejected from the mandrel assembly onto a container located below the mandrel assembly. A downstream application of heat can then be used to shrink the film. These same sleeving machines are used to apply tamper evident bands (TE band) to the cap and neck section of containers. Generally, the TE band is simply a shorter sleeve that is sized so it will not fit around the main body of the container so that the band will engage with the cap and neck section of the container during the heat shrink. The TE band therefore provides an indication of whether the container has been opened. Because of the typical short of height of TE bands, they can be difficult to apply to containers at high speeds.

Therefore, it would be desirable and advantageous to provide a system and method that enhances the ability to effectively and expediently apply tamper evident bands.

SUMMARY

In one aspect, a machine for applying a tubular band to a container moving in a feed direction includes a mandrel assembly about which tubular film is passed, the mandrel assembly include a central tooling axis and a lower output end. A film cutter is positioned for cutting the tubular film into a tubular band sized for application to a cap and neck section of the container. A band ejection arrangement is associated with the lower output end of the mandrel assembly, wherein the band ejection arrangement includes a tooling segment having a first side facing against the feed direction and a second side facing in the feed direction. A roller wheel protrudes from the first side of the tooling segment and a chamfer is provided at the second side of the tooling segment. The chamfer angles against the feed direction when moving downward along the tooling segment, such that, as the band moves downward over the tooling segment, a first side portion of the band contacts and moves over the roller wheel causing the tubular band to tilt relative to the central tooling axis so as to facilitate ejection of the tubular band in an eject direction that is at a non-zero angle relative to the central tooling axis.

In another aspect, a machine for applying a tubular band to a container moving in a feed direction includes a mandrel assembly about which tubular film is passed. The mandrel assembly includes a central tooling axis and a lower output end formed by a tooling segment having a first side facing against the feed direction and a second side facing in the feed direction, with a free-spinning wheel protruding from the first side of tooling segment and a chamfer at the second side of the tooling segment, wherein the chamfer angles against the feed direction when moving downward along the tooling segment.

The details of one or more embodiments are set forth in the accompanying drawing and the description below. Other features, objects, and advantages will be apparent from the description and drawing, and from the claims.

DETAILED DESCRIPTION

Figure 1:
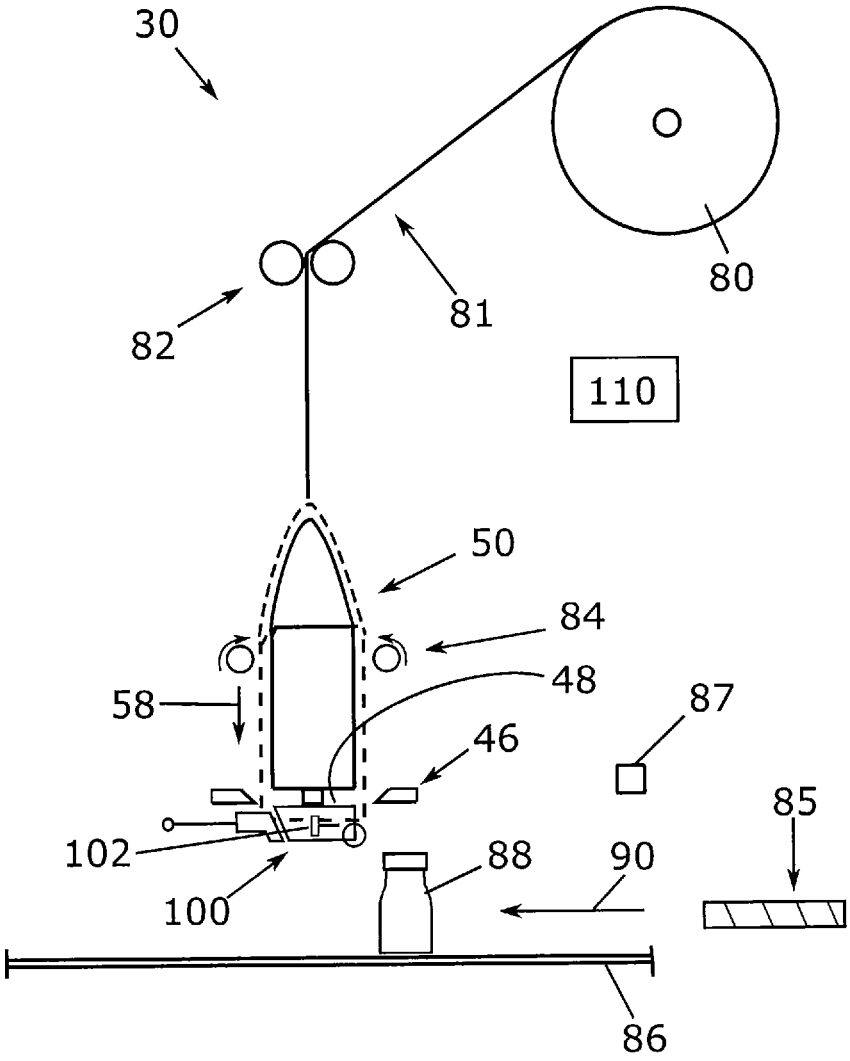
FIG. 1 is a schematic side elevation of one embodiment of a tubular shrink sleeve applying apparatus.

An exemplary tubular shrink sleeve applying apparatus 30 is shown in schematic form in FIG. 1 and includes a roll 80 or other supply of tubular film that delivers the film along a film feed path 81 to a pair of tubular film drivers 82 located above the tooling mandrel assembly 50 for moving the film down toward the mandrel assembly. The top of the tooling mandrel assembly is shaped to cause the tubular film to spread from its flat orientation to an expanded orientation as it moves down around the mandrel assembly 50. A set of film drive rollers 84 control feeding of the film downward along the mandrel assembly (e.g., per arrow 58) toward a cutting mechanism 46 that is aligned with a cutting slot 48 in the external surface of the tooling mandrel assembly. Film drivers 84 operate in coordination with drivers 82 and interact with rollers in the sleeve drive slots to move the tubular film downward along the mandrel assembly.

A container conveyor 86 passes beneath the lower output end of the mandrel assembly and carries containers 88 in a conveyance direction 90 such that cut bands that are moved off the mandrel assembly move toward the conveyor and any passing container. The container conveyance system 83 may also include an upstream container spacing device 85, such as a rotating product feed screw, to provide a set distance between successive containers moving past the exit end of the mandrel assembly during sleeve application. One or more sensors 87 may also be provided for detecting container position, with the controller configured to initiate band ejection based upon container detection. The cut band may, for example, be ejected off the mandrel assembly with the assistance of a band ejection arrangement 100, which includes one or more ejector wheels 102 that engage an external surface of the band to eject the band upon completion of the cut. A downstream application of heat can then be used to shrink the film. Other variations of the apparatus are possible, including embodiments that do not include the film drivers 82 and embodiments in which other mechanisms for sleeve ejection are provided. The various machine components, may, for example, be driven by respective servomotors that enable precise control of speed and position, with a controller 110 provided for operating the motors etc.

Figure 2:
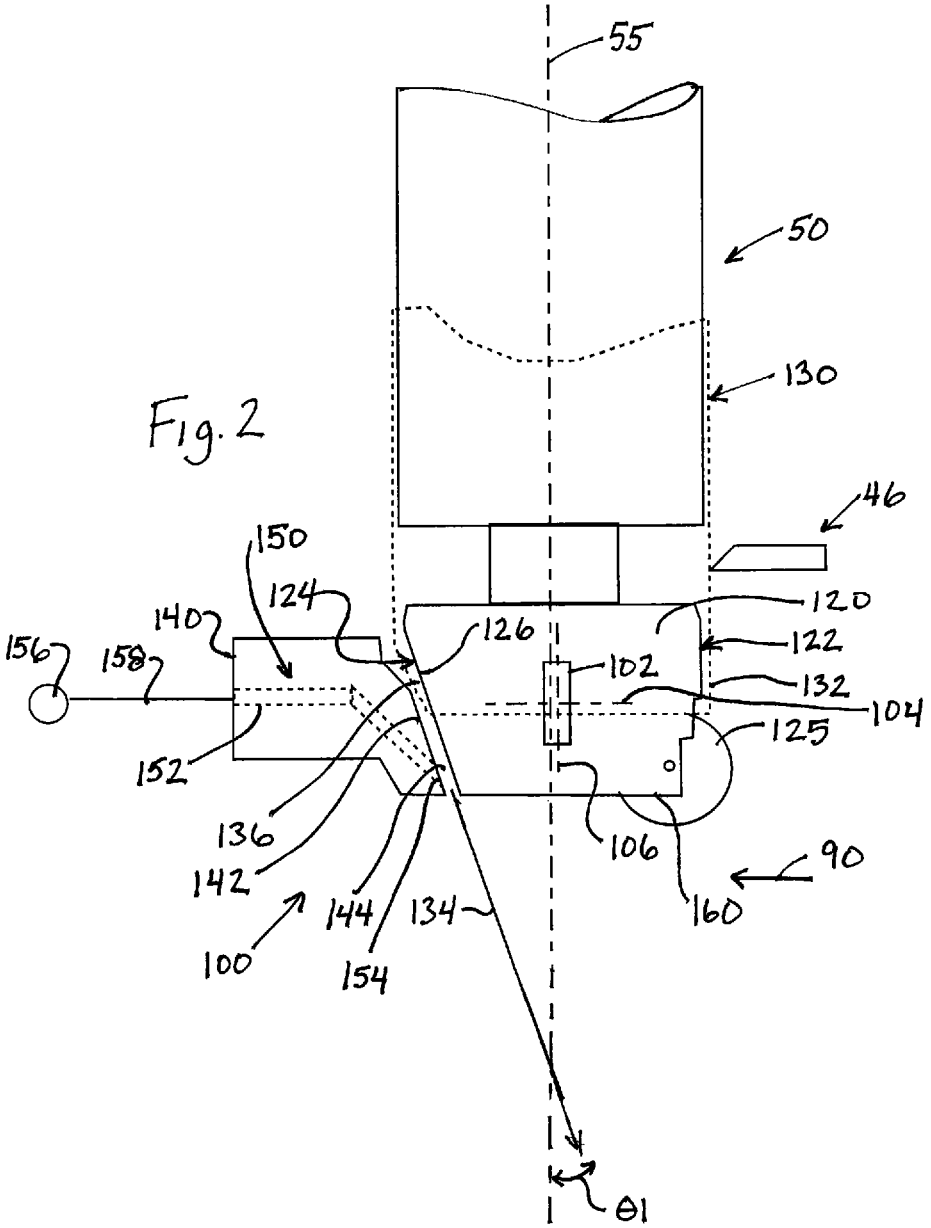
FIG. 2 is an enlarged schematic partial side elevation of the lower end of the mandrel assembly.

Notably, as best seen in FIG. 2, the band ejection arrangement 100 includes a tooling segment 120 having a first side 122 facing against the feed direction 90 and a second side 124 facing in the feed direction. A roller wheel 125 (e.g., a free-spinning wheel that is not driven) protrudes from the first side 122 of the tooling segment 120 and a chamfer 126 is provided at the second side of the tooling segment 120. Notably, the perimeter of the roller wheel 125 protrudes outward (to the right in FIG. 2) from the tooling segment beyond the normal vertically downward path of the tubular film 130, and the chamfer 126 angles against the feed direction 90 when moving downward along the tooling segment 120. With this configuration, as will be shown below, as a tamper evident band is ejected downward over the tooling segment 120, a first side portion 132 of the band contacts and moves over the roller wheel 125 causing the band to tilt relative to a central tooling axis 55 so as to facilitate ejection of the tamper evident band in an eject direction 134 that is at a non-zero angle θ1 relative to the central tooling axis 55. The chamfer 126 enables a second side portion 136 of the band to move as needed for the band to tilt. The free-spinning rotation of the roller wheel 125 due to interaction with the band during ejection helps to prevent the band from getting hung up (e.g., as could happen if the first side 122 of tooling segment 120 was chamfered against the feed direction to attempt to achieve the band tilt).

A guide 140 is positioned alongside the tooling segment 120. The guide 140 includes a chamfer 142 that aligns with the chamfer 126 of the tooling segment 120 to form an angled guide channel 144 for the second side portion 136 of the band. Here, the chamfer 142 of the guide 140 and the chamfer 126 of the tooling segment 120 include respective upper ends that are located at a height above a height of a top of the perimeter of the roller wheel 125, which causes the second side portion 136 of the band to move toward the first side portion 132 of the band before the first side portion 132 contacts the roller wheel. This configuration facilitates immediate tilt of the band as the band moves over the roller wheel section of the tooling segment.

As mentioned above, one or more rotatably driven ejector wheels 102 are located alongside the tooling segment 120 for engaging an external surface of the tamper evident band to drive the tamper evident band off of the tooling segment 120 in the eject direction 134. The ejector wheel(s) 102 are angularly offset from the roller wheel 125 about the central tooling axis 55. Here, the angular offset is by ninety degrees. The ejector wheel 102 rotates about an axis 104 that, in side elevation view, runs substantially perpendicular to the central tooling axis 55. The ejector wheel 102 is oriented such that a given point on a perimeter of the ejector wheel rotates in a plane 106 that runs substantially parallel to the central tooling axis 55. In other words, in the illustrated embodiment, the ejector wheel 102 urges the band downward, parallel to the tooling axis 55, and it is the interaction of the band with the roller wheel 125 and chamfers 126, 142 that transitions the band to move in the eject direction 134, rather than simply vertically downward.

Here, an air ejector 150 is oriented to blow air down and into the tamper evident band as the tamper evident band is ejected in the eject direction 134. In this case, the air ejector is formed by an air passage 152 (shown in dashed line) that leads to an ejection port 154 located along a lower portion of the chamfer 142 of the guide 140, so that air is output into a lower section of the angled guide channel 144. This air ejection aids in ejecting the band and also helps the band maintain its expanded shape during ejection. The air injection may be controlled by a valve 156 associated with an air feed line 158.

Here, the perimeter of the roller wheel 125 also protrudes below a bottom side 160 of the tooling segment 120.

Figure 3:
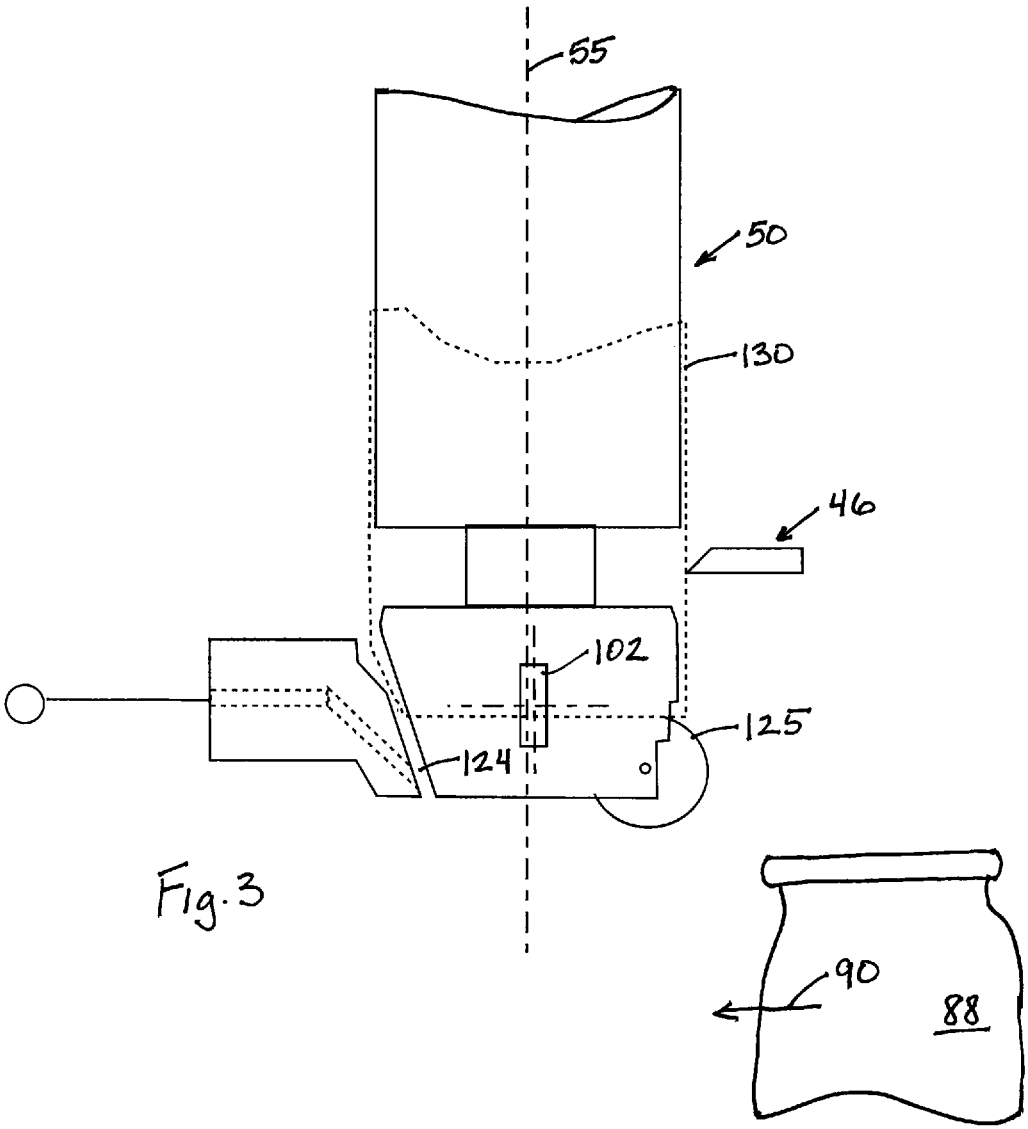
FIGS. 3-7 depict progressive production and ejection of a band onto a moving container.
Figure 4:
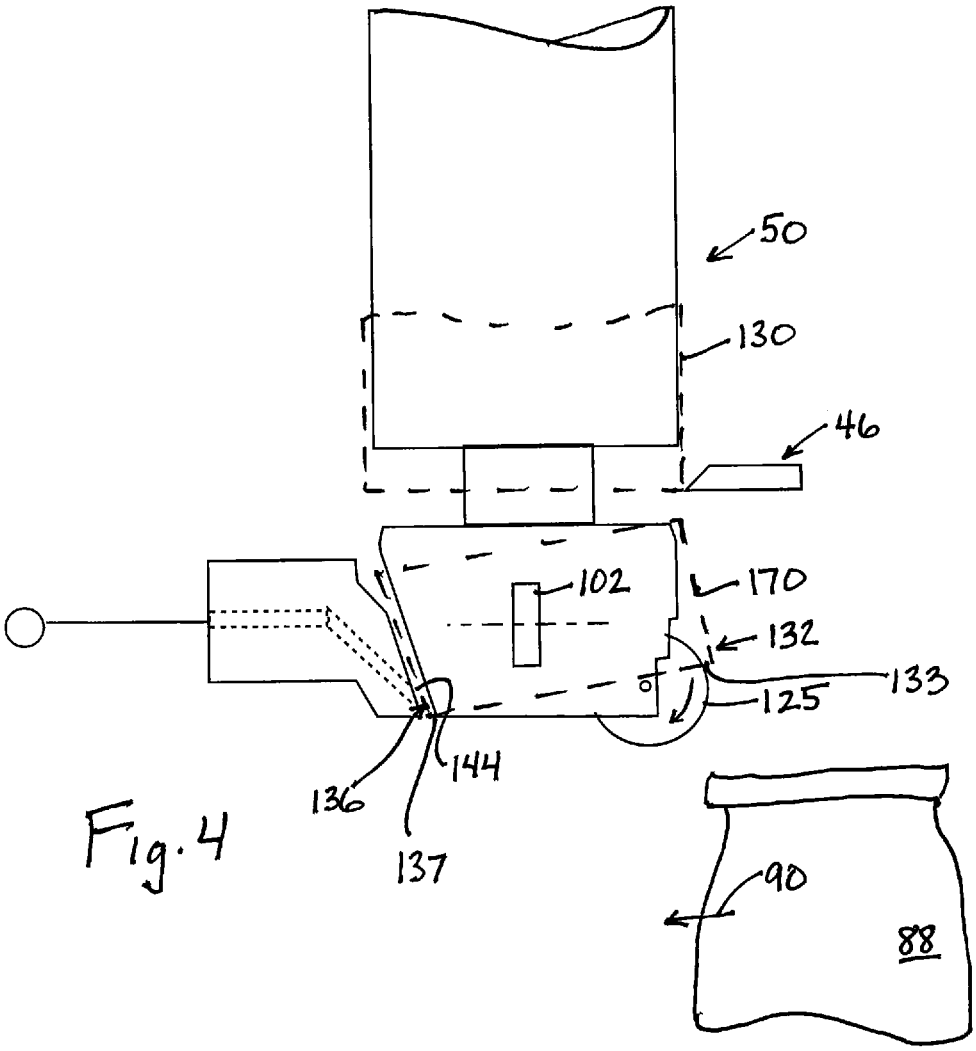

FIGS. 3-7 show a sequence of band production and ejection. In FIG. 3, the tubular film 130 has been moved into a position ready for cutting to form a band, with the bottom edge of the film just above the roller wheel 125. When the container 88 is in the correct position, the cutting mechanism 46 is operated and a band 170 is formed and begins to be ejected, per FIG. 4. In FIG. 4, the side portion 132 of the band 170 is moving over the roller wheel 125 and the band 170 is already tilted, with the lower edge of band side portion 136 at the bottom of the angled guide channel 144. As the band 170 ejects, the side portion 136 leaves the guide channel causing some rotation of the band 170 (here counterclockwise) while the band side portion 132 remains moving over the roller wheel 125, and the lower edge of band side portion 136 contacts the leading side (or downstream side) of the container 88, per FIG. 5. This causes the band 170 to rotate back in the other direction (here clockwise) as the band 170 moves onto the cap and neck region of the moving container 88, per FIG. 6. Per FIG. 7, the band 170 moves more fully onto the moving container 88 and continues moving down until it reaches a stop point based upon contact of the lower edge of the band 170 with the walls of the container 88.

Figure 5:
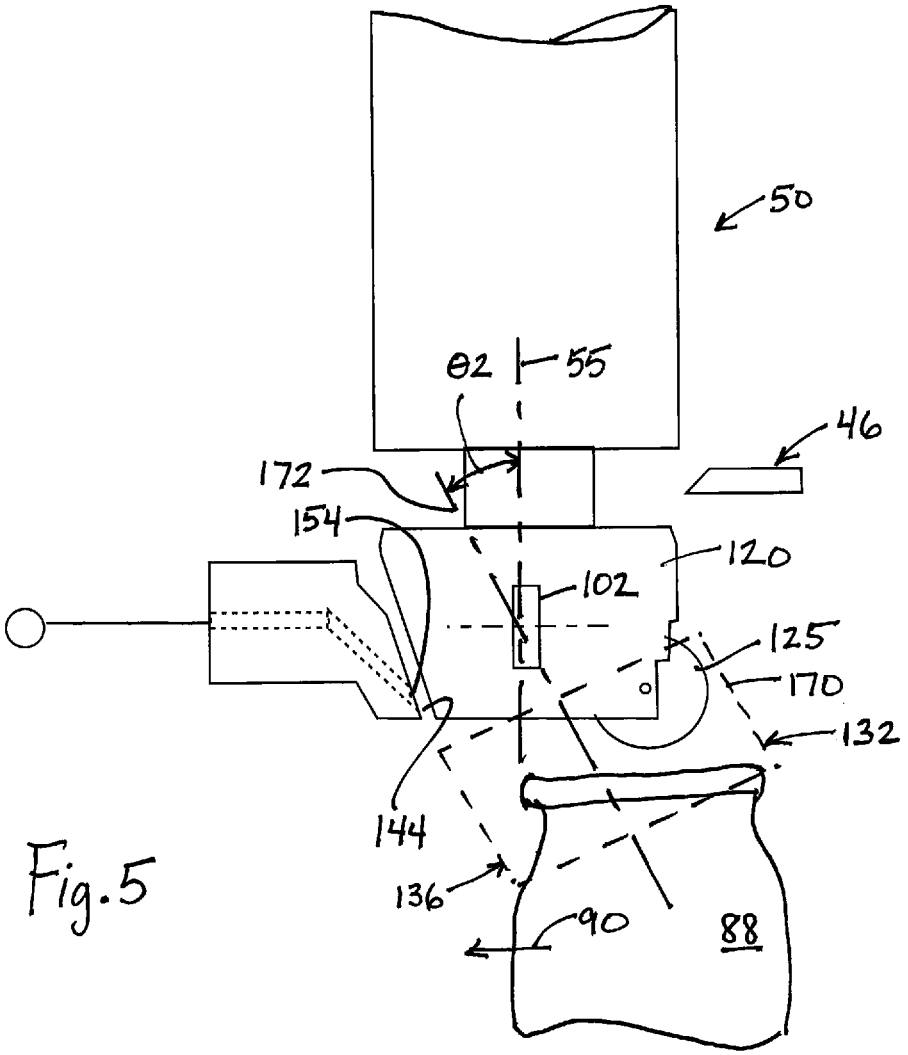
Figure 6:
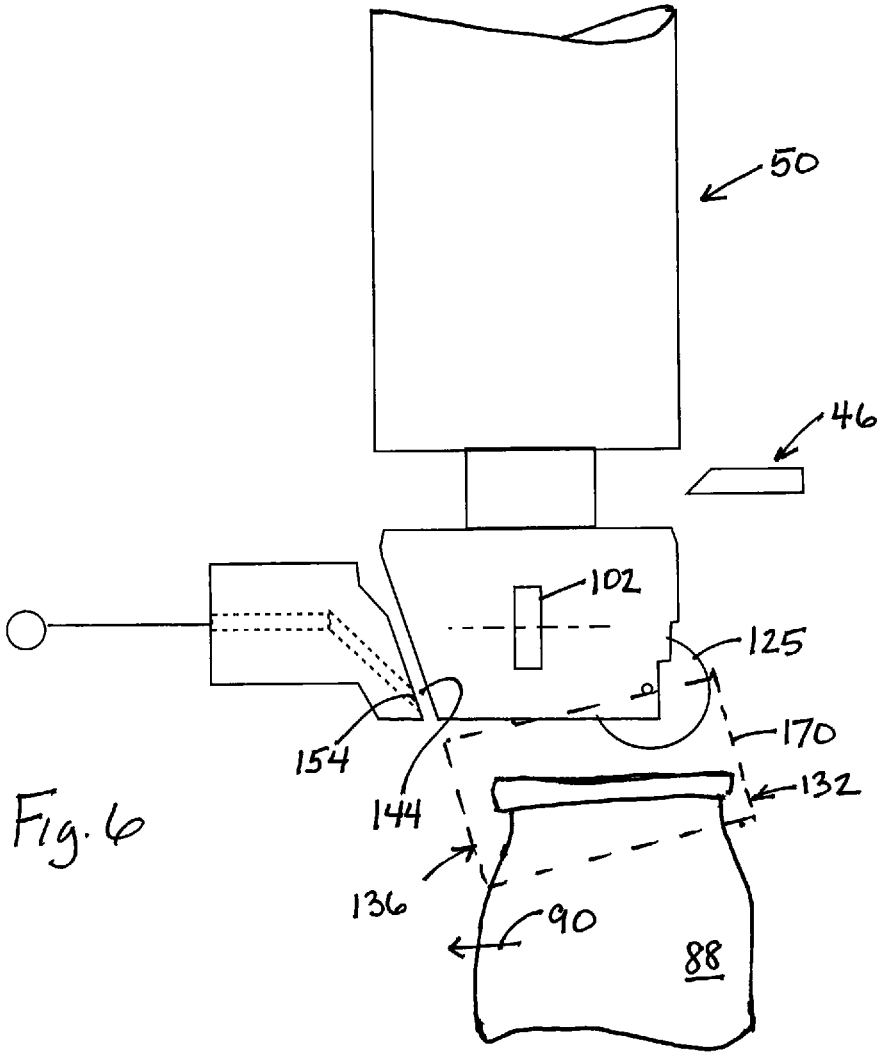
Figure 7:
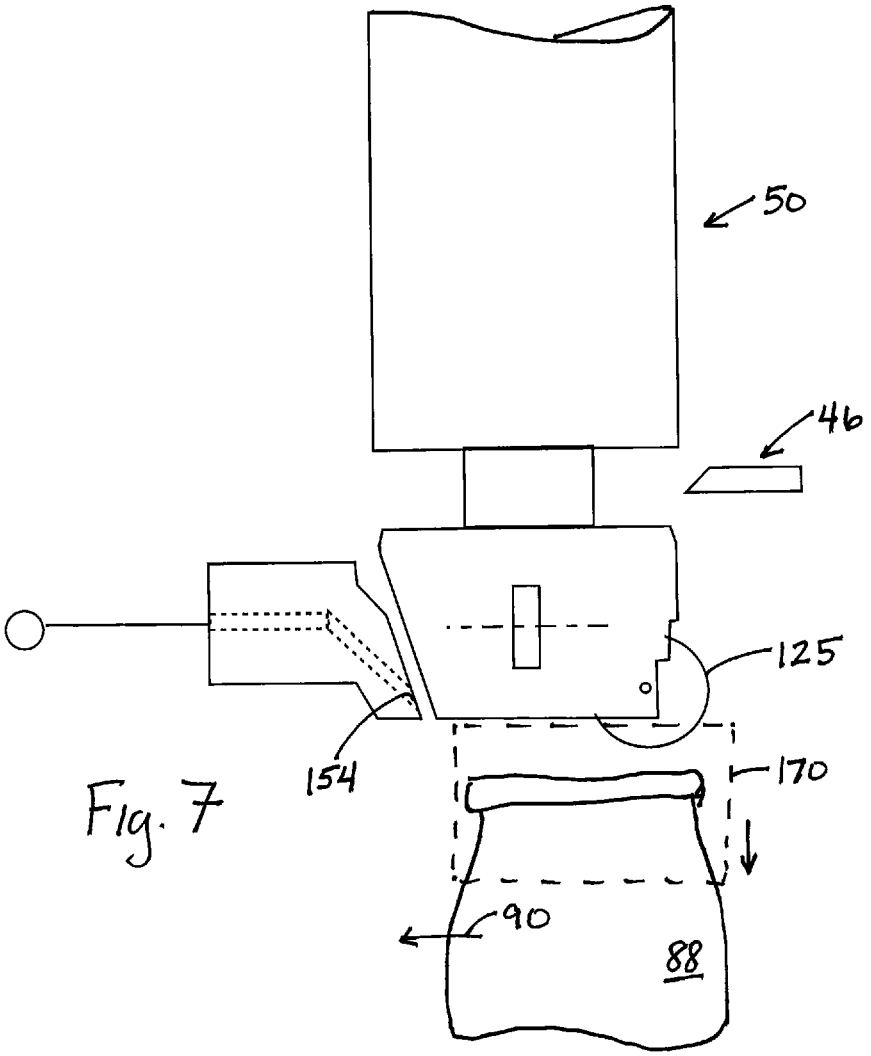

As seen in FIG. 5, the tubular band 170 moves downward off of the tooling segment 120 while the tubular band is in an orientation in which a central axis 172 of the tubular band 170 is at a non-zero angle θ2 relative to the central tooling axis 55. The first side portion 132 of the tubular band is located upstream relative to the feed direction 90, and the second side portion 136 of the tubular band is located downstream relative to the feed direction 90. Thus, a lower edge 137 (FIG. 4) of the second side portion 136 of the tubular band 170 moves downward below the tooling segment 120 before a lower edge 133 of the first side portion 132 of the tubular band 170.

In one implementation, the air injection via port 154 occurs continuously during operation of the system. In this implementation, the valve 156 is opened when the machine is turned on, and the valve 156 is closed when the machine is turned off. In another implementation, the air injection via port 154 may be timed to occur in pulses, with each pulse occurring after a band 170 has been cut and the side portion 136 of the band has moved below the port 154.

Thus, the described apparatus provides a desirable system and method for applying tubular bands, such as tamper evident bands, to moving containers at relatively high throughput, achievable by the angular ejection of the bands.

It is to be clearly understood that the above description is intended by way of illustration and example only, is not intended to be taken by way of limitation, and that other changes and modifications are possible.

What is claimed is:

1. A machine for applying a tubular band to a container moving in a feed direction, the machine including:

a mandrel assembly about which tubular film is passed, the mandrel assembly includes a central tooling axis and a lower output end;

a film cutter positioned for cutting the tubular film into a tubular band sized for application to a cap and neck section of the container;

a band ejection arrangement associated with the lower output end of the mandrel assembly, wherein the band ejection arrangement includes a tooling segment having a first side facing against the feed direction and a second side facing in the feed direction, a roller wheel protruding from the first side of the tooling segment and a chamfer at the second side of the tooling segment, wherein the chamfer angles against the feed direction when moving downward along the tooling segment, such that, as the tubular band moves downward over the tooling segment, a first side portion of the tubular band contacts and moves over the roller wheel causing the tubular band to tilt relative to the central tooling axis so as to facilitate ejection of the tubular band in an eject direction that is at a non-zero angle relative to the central tooling axis.

2. The machine of claim 1, wherein the roller wheel is a free-spinning wheel.

3. The machine of claim 1, further comprising a guide positioned alongside the tooling segment, the guide including a chamfer that aligns with the chamfer of the tooling segment to form an angled guide channel for the second side portion of the tubular band.

4. The machine of claim 3, wherein the chamfer of the guide and the chamfer of the tooling segment each include an upper end that is located at a height above a height of a top of a perimeter of the roller wheel for causing the second side portion of the tubular band to move toward the first side portion of the tubular band before the first side portion contacts the roller wheel.

5. The machine of claim 3, further comprising an air ejector oriented to blow air down and into the tubular band as the tubular band is ejected in the eject direction.

6. The machine of claim 5, wherein the air ejector is located in a lower portion of the guide and outputs air into a lower section of the angled guide channel.

7. The machine of claim of claim 1, further comprising at least one rotatably driven ejector wheel alongside the tooling segment for engaging an external surface of the tubular band to drive the tubular band off of the tooling segment, wherein the eject direction is at least partly against the feed direction, wherein the ejector wheel is angularly offset from the roller wheel about the central tooling axis.

8. The machine of claim 7, wherein the ejector wheel rotates about an axis that runs substantially perpendicular to the central tooling axis.

9. The machine of claim 7, wherein the ejector wheel is oriented such that a given point on a perimeter of the ejector wheel rotates in a plane that runs substantially parallel to the central tooling axis.

10. A machine for applying a tubular band to a container moving in a feed direction, the machine including:

a mandrel assembly about which tubular film is passed, wherein the mandrel assembly includes a central tooling axis and a lower output end formed by a tooling segment having a first side facing against the feed direction and a second side facing in the feed direction, with a free-spinning wheel protruding from the first side of tooling segment and a chamfer at the second side of the tooling segment, wherein the chamfer angles against the feed direction when moving downward along the tooling segment.

11. The machine of claim 10, wherein the free-spinning wheel also protrudes below a bottom side of the tooling segment.

12. The machine of claim 10, wherein, as the tubular band moves downward over the tooling segment, a first side portion of the tubular band contacts the free spinning wheel and the tubular band tilts relative to the central tooling axis so as to facilitate ejection of the tubular band in an eject direction that is at a non-zero angle relative to the central tooling axis.

13. The machine of claim of claim 12, further comprising at least one rotatably driven ejector wheel alongside the tooling segment for engaging an external surface of the tubular band to drive the tubular band off of the tooling segment, wherein the eject direction is at least partly against the feed direction, wherein the ejector wheel is angularly offset from the free spinning wheel about the central tooling axis.

14. The machine of claim 13, wherein the ejector wheel rotates about an axis that runs substantially perpendicular to the central tooling axis.

15. The machine of claim 13, wherein the ejector wheel is oriented such that a given point on a perimeter of the ejector wheel rotates in a plane that runs substantially parallel to the central tooling axis.

16. The machine of claim 10, further comprising a guide positioned alongside the tooling segment, the guide including a chamfer that aligns with the chamfer of the tooling segment to form an angled guide channel for the second side portion of the tubular band.

17. The machine of claim 16, further comprising an air ejector oriented to blow air down and into the tubular band as the tubular band is ejected in the eject direction, wherein the air ejector is located in a lower portion of the guide and outputs air into a lower section of the angled guide channel.

18. The machine of claim 10, further comprising an air ejector oriented to blow air down and into the tubular band as the tubular band is ejected in the eject direction.

19. The machine of claim 10, wherein, as the tubular band moves downward over the tooling segment, a first side portion of the tubular band contacts the free spinning wheel and the tubular band tilts relative to the central tooling axis so cause the tubular band to move off of the tooling segment while in an orientation in which a central axis of the tubular band is at a non-zero angle relative to the central tooling axis.

20. The machine of claim 19, wherein the first side portion of the tubular band is located upstream relative to the feed direction, wherein a second side portion of the tubular band is located downstream relative to the feed direction, and a lower edge of the second side portion of the tubular band moves downward below the tooling segment before a lower edge of the first side portion of the tubular band.

* * * * *